US007223105B2

(12) United States Patent
Weiss et al.

(10) Patent No.: US 7,223,105 B2
(45) Date of Patent: May 29, 2007

(54) CABLE CONNECTOR INCORPORATING ANISOTROPICALLY CONDUCTIVE ELASTOMER

(75) Inventors: Roger E. Weiss, Foxboro, MA (US); David M. Barnum, Dartmouth, MA (US)

(73) Assignee: Paricon Technologies Corporation, Fall River, MA (US)

( * ) Notice: Subject to any disclaimer, the term of this patent is extended or adjusted under 35 U.S.C. 154(b) by 0 days.

(21) Appl. No.: 10/621,739

(22) Filed: Jul. 17, 2003

(65) Prior Publication Data

US 2005/0101167 A1 May 12, 2005

Related U.S. Application Data

(63) Continuation-in-part of application No. 09/465,056, filed on Dec. 16, 1999, now Pat. No. 6,854,985.

(51) Int. Cl.
*H01R 12/00* (2006.01)

(52) U.S. Cl. ..... 439/66; 439/497; 439/580

(58) Field of Classification Search ..... 439/91, 439/492, 578, 329, 74, 63–66, 497, 580–581, 439/86

See application file for complete search history.

(56) References Cited

U.S. PATENT DOCUMENTS 3,613,049 A * 10/1971 Niedzwiecki ..... 439/329
4,003,621 A 1/1977 Lamp ..... 339/59
4,417,096 A * 11/1983 Willette ..... 174/71 R
4,421,370 A * 12/1983 Treakle et al. ..... 439/91
4,526,432 A * 7/1985 Cronin et al. ..... 439/320
4,538,865 A * 9/1985 Wakabayashi et al. ..... 439/66
4,750,881 A * 6/1988 Kikuchi et al. ..... 400/352
4,808,112 A * 2/1989 Wood et al. ..... 439/66
4,820,376 A 4/1989 Lambert et al. ..... 156/643
4,828,512 A * 5/1989 McCormick et al. ..... 439/495
4,913,656 A * 4/1990 Gordon et al. ..... 439/67
4,975,068 A * 12/1990 Squires ..... 439/67
5,385,490 A * 1/1995 Demeter et al. ..... 439/579
5,459,500 A * 10/1995 Morris et al. ..... 347/50
5,782,645 A * 7/1998 Stobie et al. ..... 439/289
5,795,162 A 8/1998 Lambert ..... 9/9
6,019,610 A 2/2000 Glatts, III ..... 439/66
6,226,862 B1 * 5/2001 Neuman ..... 29/830
6,230,397 B1 * 5/2001 Tighe ..... 29/830
6,786,762 B2 * 9/2004 Buck et al. ..... 439/493

* cited by examiner

*Primary Examiner*—Truc Nguyen
(74) *Attorney, Agent, or Firm*—Brian M. Dingman; Mirick, O'Connell, DeMallie & Lougee, LLP

(57) ABSTRACT

A separable electrical connector for separably, electrically interconnecting the conductors of one multi-conductor cable to the conductors of a second electrical device that may be an electrical device such as a chip, or a second multi-conductor cable, or a flexible or rigid printed circuit board. The connector includes a layer of anisotropic conductive elastomer (ACE) in electrical contact with the conductors of the cable and the conductors of the second electrical device. A clamp or another type of mechanical device compresses the ACE, to provide electrical signal paths between the conductors of the cable and the second electrical device, through the ACE.

10 Claims, 5 Drawing Sheets

CABLE CONNECTOR INCORPORATING ANISOTROPICALLY CONDUCTIVE ELASTOMER

CROSS REFERENCE TO RELATED APPLICATION

This application is a continuation in part of application Ser. No. 09/465,056, entitled "Elastomeric Interconnection Device and Methods for Making Same" filed on Dec. 16, 1999 now U.S. Pat. No. 6,854,985. Priority is claimed.

FIELD OF THE INVENTION

This invention relates to separable cable connectors with advanced electrical performance.

BACKGROUND OF THE INVENTION

Electrical cables are typically connected to devices such as printed circuit boards using pin-type connectors that terminate the cable and fit into a connector having a complementary shape permanently mounted to the electrical device. Cable-to-cable connectors are accomplished in a similar fashion. However, these connectors are relatively bulky and expensive, and require the additional steps of connecting the connectors to the end of the cable and to the printed circuit board.

Another problem with such connectors is that the combination mechanical and electrical connection between each of the connectors of the cable and the terminating connector, the connection between the connectors themselves, and the connection of the connector to the printed circuit board, each add incrementally to the resistance/impedance of the signal path, resulting in slower maximum signal transfer speeds and increased power dissipation. Further, these connectors are relatively difficult to couple and decouple; most times these operations require human intervention.

SUMMARY OF THE INVENTION

Anisotropic Conductive Elastomer (ACE) is a composite of conductive metal elements in an elastomeric matrix that is normally constructed such that it conducts along one axis only. In general this type of material is made to conduct through the thickness. One form of ACE achieves its anisotropic conductivity by mixing magnetic particles with a liquid resin, forming the mix into a continuous sheet and curing the sheet in the presence of a magnetic field. This results in the particles forming columns through the sheet thickness that are electrically conductive. The resulting structure has the unique property of being flexible and anisotropically conductive.

It is therefore an object of this invention to provide an extremely high speed, easily separable cable connector.

This invention results from the realization that high speed, simple to use cable termination connectors can be accomplished with a layer of ACE compressed between the cable end and the electrical device to which the cable is being conductively interconnected.

Planar-type connectors are one preferred embodiment of the present invention. These connectors include ribbon cable to ribbon cable; ribbon cable to printed circuit board (PCB); ribbon cable to electrical device; flex cable to flex cable; flex cable to PCB; flex cable to electrical device; and coaxial (or multi-axial) cable to any of these. Each of these applications comprises of a first array of conductors that is interconnected to a second array via a compressed layer of ACE material between the two arrays. A clamping mechanism is employed to maintain the compressive load, and an alignment system assures the alignment of the two arrays. If needed to provide proper registration between the conductors of an array, the conductors can be connected to a substrate such as a printed circuit board, in which case the layer of ACE is used to interconnect the substrates.

This invention features a separable electrical connector for separably, electrically interconnecting the conductors of one multi-conductor cable to the conductors of a second multi-conductor cable, comprising a layer of anisotropic conductive elastomer (ACE) in electrical contact with the conductors of both of the cables, and means for compressing the ACE, to provide electrical signal paths between the conductors of the cables through the ACE. At least one cable may be a ribbon cable, in which case the connector may further comprise a paddle board directly connected to the conductors of the ribbon cable, with the ACE layer against the paddle board. Both cables may be ribbon cables, in which case there may be paddle boards directly connected to the conductors of each of the ribbon cables, with the ACE layer against both paddle boards.

At least one cable may be a flex cable, or both cables may be flex cables, in which case the conductors of both flex cables may be on the surfaces of the cables, and terminate in pads that face one another in the connector, with the ACE lying directly against the pads of both cables. Both cables may be multi-axial cables each comprising at least two spaced coaxial conductors, in which case the ACE may lie directly against the conductors of both cables, or the electrical connector may further comprise printed circuit boards directly connected to the conductors of each of the cables, with the ACE layer against both boards.

Also featured in the invention is a separable electrical connector for separably, electrically interconnecting the conductors of a ribbon cable to the conductors of a second electrical device, comprising a layer of anisotropic conductive elastomer (ACE) in electrical contact with the conductors of both the cable and the second electrical device, and means for compressing the ACE, to provide electrical signal paths between the conductors of the cable and the conductors of the second electrical device through the ACE. The second electrical device may be a printed circuit board (PCB), or a second ribbon cable.

Also featured in the invention is a separable electrical connector for separably, electrically interconnecting the conductors of a flex cable to the conductors of a second electrical device, comprising a layer of anisotropic conductive elastomer (ACE) in electrical contact with the conductors of both the cable and the second electrical device, and means for compressing the ACE, to provide electrical signal paths between the conductors of the cable and the conductors of the second electrical device through the ACE. The second electrical device may be a printed circuit board (PCB) or a ribbon cable.

BRIEF DESCRIPTION OF THE DRAWINGS

Other objects, features and advantages will occur to those skilled in the art from the following description of the preferred embodiments, and the accompanying drawings, in which.

DESCRIPTION OF THE PREFERRED EMBODIMENTS

Figure 1A:
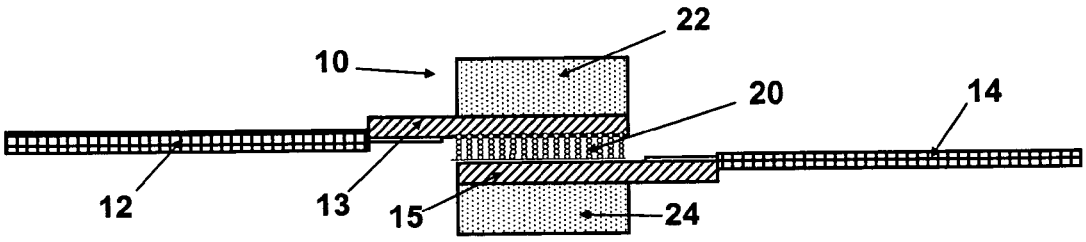
FIG. 1A is a schematic, cross-sectional view of a preferred ribbon cable to ribbon cable separable electrical connector according to this invention.
Figure 1B:
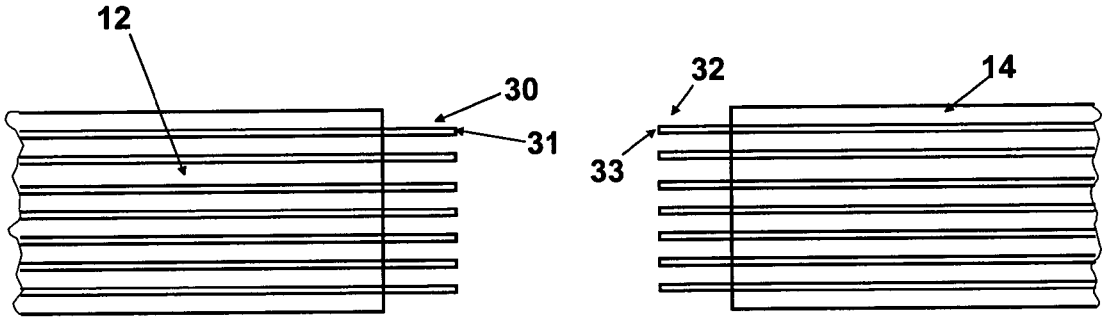
FIG. 1B is a top view of the two ribbon cables that are connected by the connector of FIG. 1A.
Figure 1C:
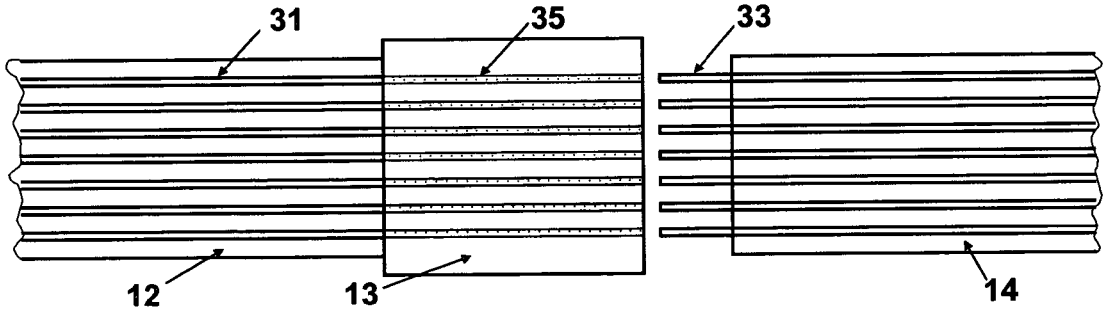
FIG. 1C is a top view of the partially assembled connector of FIG. 1A.

FIG. 1 presents a preferred embodiment of this invention as applied to a ribbon cable to ribbon cable interconnection. Connector 10 interconnects conductor set 30 of ribbon cable 12 to conductor set 32 of ribbon cable 14. In this embodiment, each ribbon cable 12, 14 is terminated to a small circuit board (paddle board) 13, 15, respectively. Boards 13 and 15 include surface conductive traces such as trace 35 on board 13, FIG. 1C. These surface traces are functionally stiffer, properly spaced (registered) continuations of the conductors of the ribbon cables. The circuitry on the circuit board is preferably arranged to optimize the functionality of interconnect 10. Ground planes and controlled impedance lines can be employed for high-speed interconnection. Circuit boards 13 and 15 are aligned to each other, and electrically interconnected by ACE layer 20. Clamp members 22, 24 are urged toward one another (for example using bolts) to provide the alignment between the conductors of the cables, and the ACE compression. Additional components can also be employed to add functionality to interconnect 10, for example a spring clamp structure could be used to provide the compressive force needed for the ACE.

Figure 2:
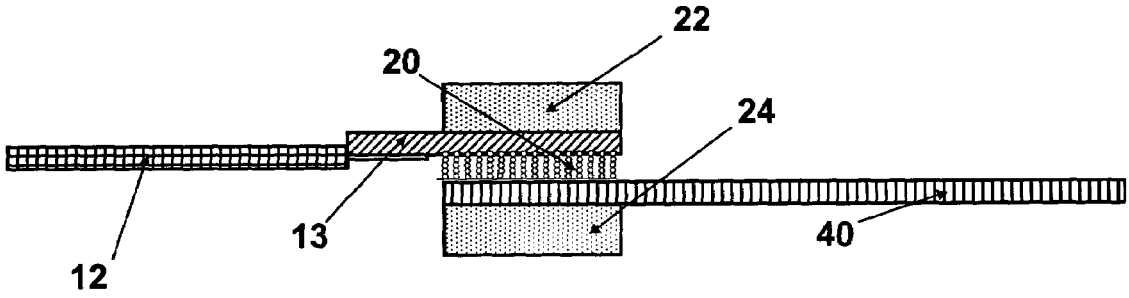
FIG. 2 is a view similar to that of FIG. 1A but for a ribbon cable to printed circuit board (PCB) separable electrical connector according to this invention.

Ribbon Cable to PCB (FIG. 2)

FIG. 2 presents the preferred embodiment of a ribbon cable 12 to PCB 40 connector of the invention. The cable half of the interconnect is as described above, with cable 12 and paddle board 13. In this embodiment, the other half of the interconnect is PCB 40, which has surface lands, pads or other conductors to which the cable conductors are being connected through ACE layer 20 compressed by clamps 22, 24.

Figure 3:
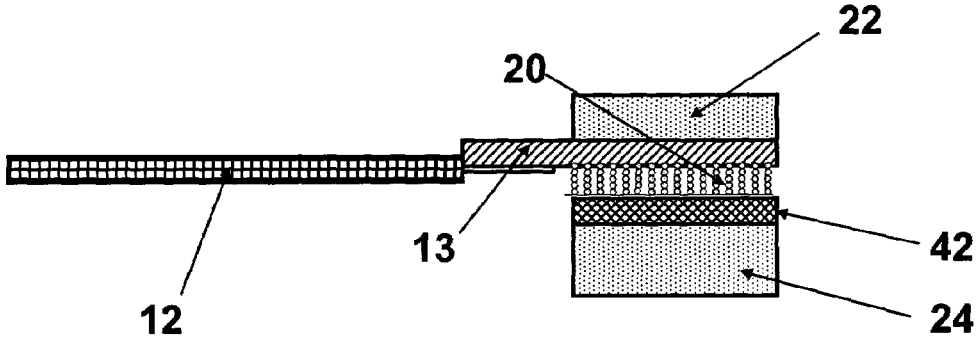
FIG. 3 is a view similar to that of FIG. 1A for a ribbon cable to electrical device separable electrical connector of this invention.

Ribbon Cable to Device (FIG. 3)

FIG. 3 presents the preferred embodiment of a ribbon cable to electrical device connector of the invention. The cable half of the interconnect 12, 13, is as before. In this application, the other half of the interconnect includes electrical device 42, with electrical contacts being interconnected to the conductors of cable 12.

Figure 4A:
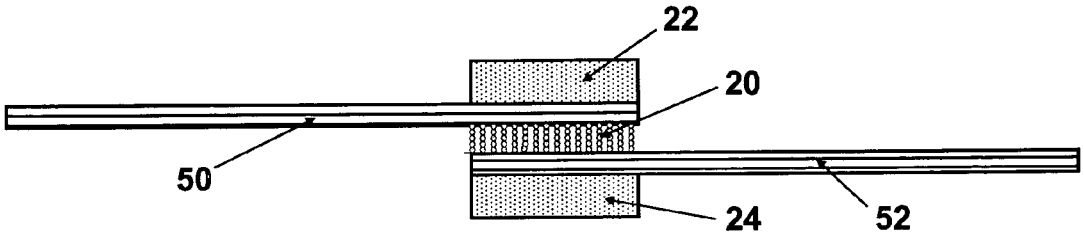
FIGS. 4A and 4B are views similar to those of FIGS. 1A and 1B for a flex cable to flex cable separable electrical connector of this invention.
Figure 4B:
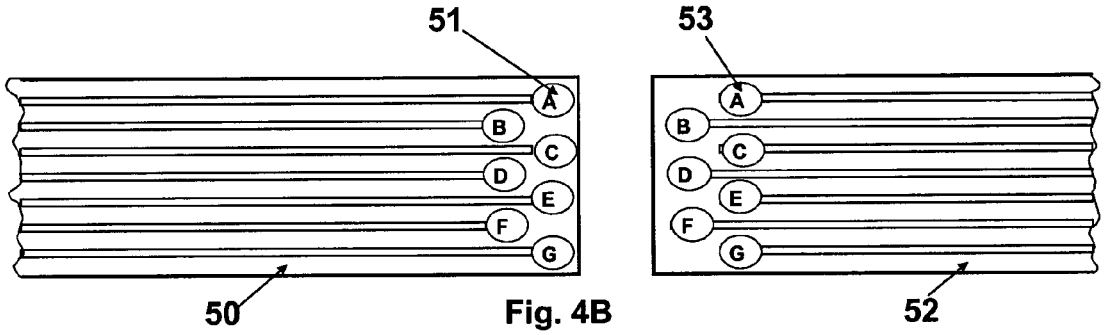

Flex Cable to Flex Cable (FIG. 4)

FIG. 4 presents one preferred embodiment of an interconnection of a flex cable assembly. In this example, flex cables 50, 52 have conductive pad features 51, 53, respectively (labeled A–G) formed on their facing surfaces. No paddle board is required because these pads provide sufficient contact area for ACE 20, and also proper inter-contact registration. Because there is no intervening connection between the cable and the ACE, this system will have the highest frequency response possible.

Figure 5:
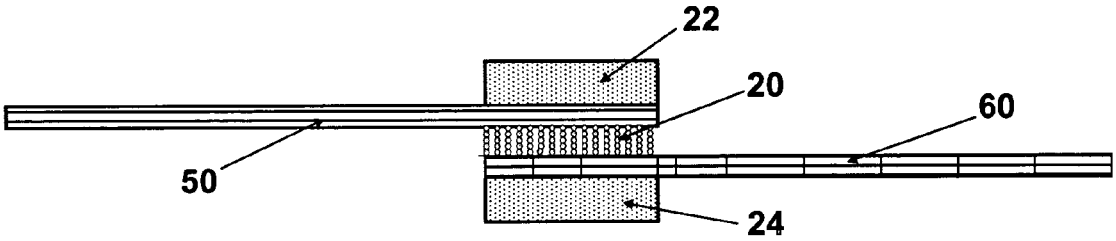
FIG. 5 is a view similar to that of FIG. 1 but for a flex cable to printed circuit separable electrical connector of this invention.

Flex Cable to Board (FIG. 5)

FIG. 5 presents a flex cable 50 to board 60 embodiment. This embodiment also does not need paddle boards.

Figure 6:
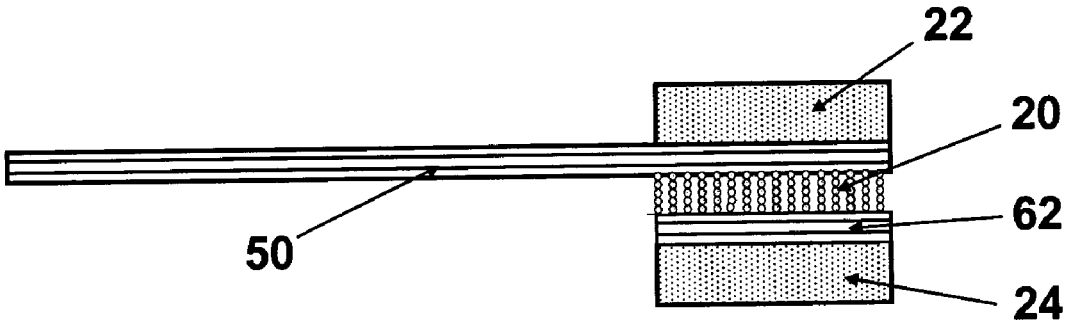
FIG. 6 is a view similar to that of FIG. 1 but for a flex cable to electrical device separable electrical connector of this invention.

Flex Cable to Device (FIG. 6)

FIG. 6 presents a flex cable 50 to electrical device 62 embodiment, which also does not need paddle boards.

Figure 7A:
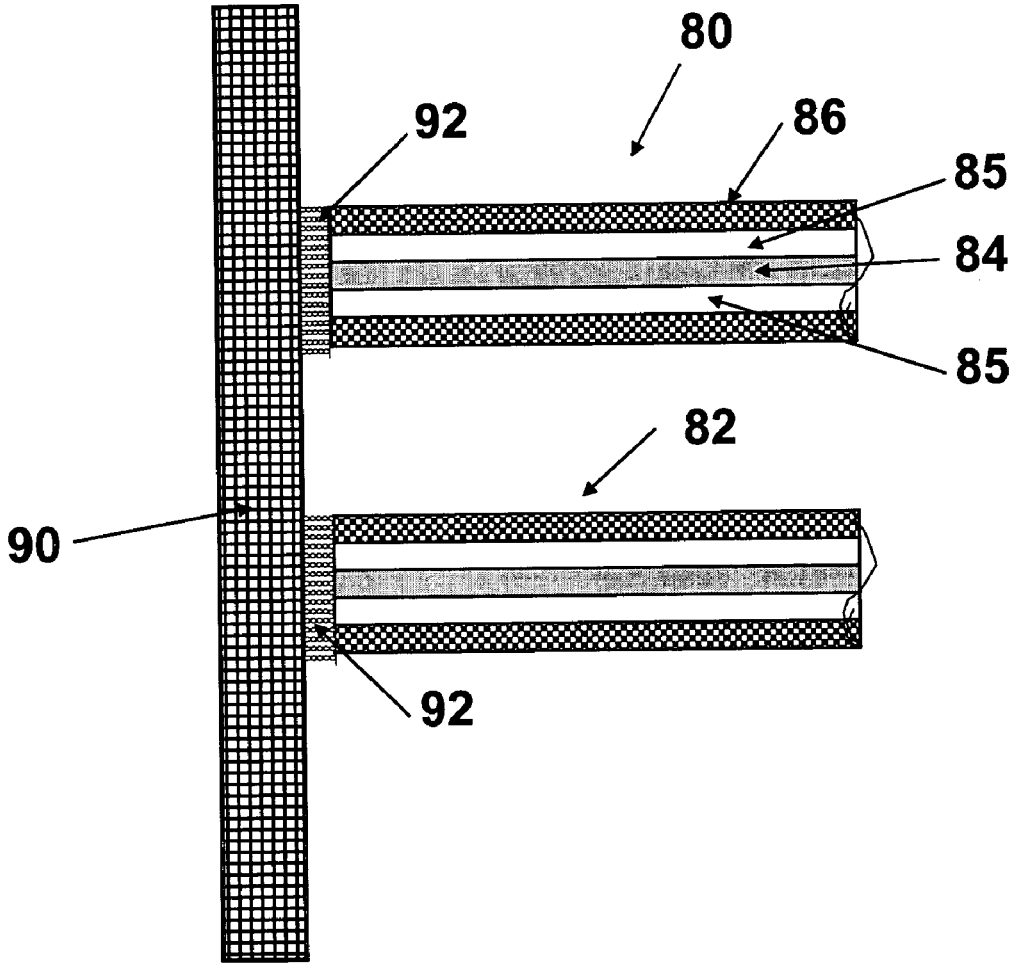
FIG. 7A is a partial, schematic, cross-sectional view of a multi-axial to multi-axial connector of this invention.

FIG. 7A depicts partially a separable connector of this invention for interconnecting two or more multi-axial cables. Multi-axial cables have two or more coaxial conductors, separated from one another by insulating layers. Two such cables 80 and 82 are shown in FIG. 7A. Cable 80, for example, includes central conductor 84 surrounded by annular insulating layer 85, which is itself surrounded by annular conductor 86. Most times, such cables also include an outer insulating and protective covering, not shown in this drawing. Cable 82 in this embodiment is identical to cable 80, although such is not a limitation of this invention. Cables 80 and 82 can be electrically interconnected through ACE layer 92 with backing PCB 90 that includes electrical traces that interconnect the conductors of the cables as appropriate. Not shown in this drawing is the means for compressing the ACE, which can be accomplished for example by including a sleeve or another connect that couples the cable to PCB 90 and provides sufficient compressive force needed for the ACE layer. An alternative to this arrangement would be to connect the cables through PCB 90 by having through-hole connections in the PCB, in which case cable 82 would be on the left side of PCB 90, with a second layer of ACE between cable 82 and PCB 90. The connection result is the same.

Figure 7B:
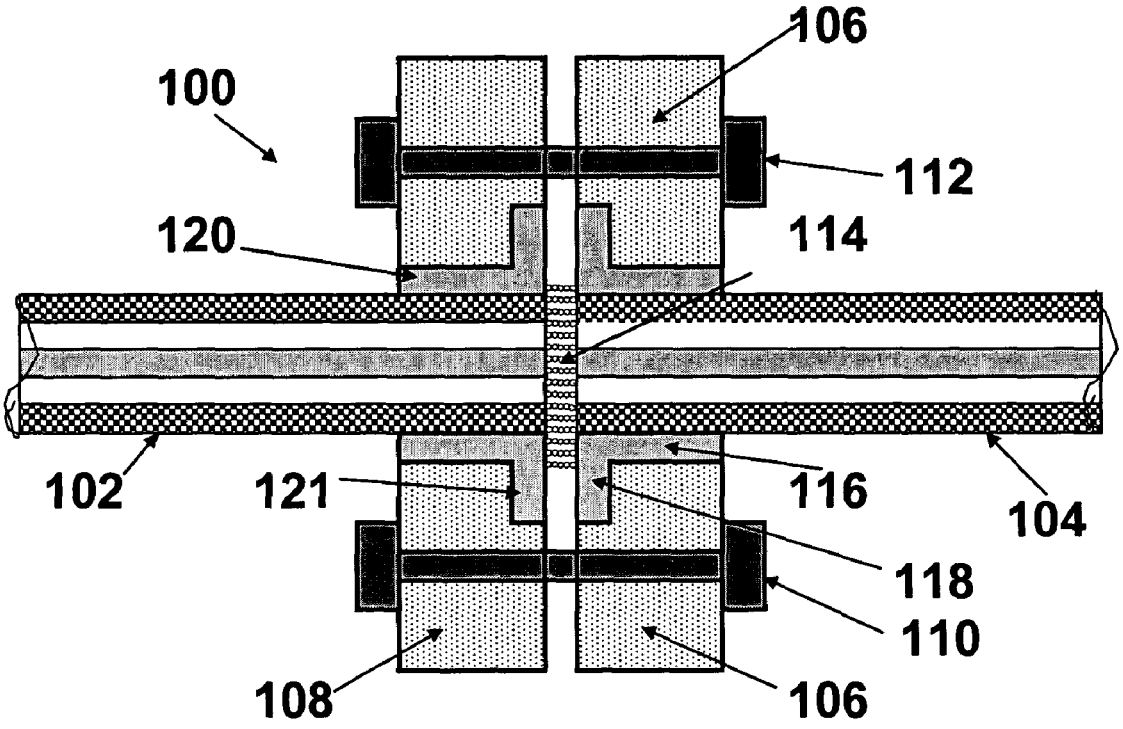
FIG. 7B is another embodiment of a multi-axial to multi-axial connector of this invention.

The connection between two multi-axial cables can be simplified when the cables are aligned, as are cables 102 and 104, FIG. 7B. In this case, ACE layer 114 directly interconnects the conductors of the two cables; there is no need for a PCB. The means for compressing the ACE comprises mounting sleeves 116 and 120 having shoulders 118 and 121, respectively, along with clamps 106 and 108 that are pulled toward one another by bolts 110 and 112. Sleeves 116 and 120 can be crimped onto the cables, or created by potting the ends of the cables in a settable medium such as plastic resin, and then polishing to provide flat faces that meet the ACE material. The mounting sleeves could be continuations of the ground shield of the cable, or not. The clamp assembly could be a threaded sleeve assembly or one of many connector styles available. It could also be in the well-known 38999 format.

Multi-axial cables can also be connected to PCBs as shown in FIG. 7A. Such cables can also be connected to the electrical devices in a manner similar to that shown in FIG. 6, except with the cable typically aligned perpendicular to the device rather than parallel to the device. Multi-axial cables can be connected to a flex cable in a similar fashion to the connection shown in FIG. 4A, but again with the cable typically aligned at right angles to the surface of the flex cable.

ALTERNATIVE EMBODIMENTS

Various features of the described invention can be combined in numerous ways to achieve other unique functions. For example, probe cables can be constructed to interconnect a high speed device under test to a device test system in what is termed a "probe head". The probe head would be one half of the flex, ribbon or multi-axial cable described above, and thus comprise a cable of a type described above, a board if necessary, and a layer of ACE.

Other embodiments will occur to those skilled in the art and are within the following claims.

What is claimed is:

1. A separable electrical connector for separably, electrically interconnecting the conductors of one multi-conductor cable to the conductors of a second multi-conductor cable, comprising:

at least two multi-conductor cables, each cable having a plurality of at least partially-exposed conductors, with the exposed conductors of two of the cables in proximity to one another, at least one such cable being a multi-axial cable comprising at least two spaced coaxial conductors;

anisotropic conductive elastomer (ACE) in electrical contact directly with the exposed conductors that are in proximity to one another; and mechanical structure that holds at least the multi-axial cable and compresses the ACE, to provide electrical signal paths between the conductors of the cables that are in proximity to one another through the ACE.

2. The electrical connector of claim 1 in which at least one cable is a ribbon cable.

3. The electrical connector of claim 1 in which at least one cable is a flex cable.

4. The electrical connector of claim 1 in which two cables are multi-axial cables each comprising at least two spaced coaxial conductors.

5. The electrical connector of claim 1 in which the mechanical structure comprises a mounting sleeve coupled to at least one multi-axial cable.

6. The electrical connector of claim 2, further comprising a paddle board having conductors that are directly connected to the conductors of the ribbon cable, with the ACE layer against the conductors of paddle board.

7. The electrical connector of claim 4 in which the ACE lies directly against the conductors of both multi-axial cables.

8. The electrical connector of claim 4 further comprising printed circuit boards with conductors directly connected to the conductors of each of the multi-axial cables, with the ACE layer against the conductors of both boards.

9. The electrical connector of claim 5 in which the mechanical structure further comprises a clamp assembly coupled to the mounting sleeve.

10. The electrical connector of claim 5 in which the mounting sleeve is made by potting the end of the at least one multi-axial cable in a settable medium.

* * * * *